US005579697A

United States Patent [19]

Burke

[11] Patent Number: 5,579,697

[45] Date of Patent: Dec. 3, 1996

[54] AUTO RACK PANEL GAP SEALING DEVICE

[75] Inventor: Michael K. Burke, Aurora, Ill.

[73] Assignee: Zeftek, Inc., Montgomery, Ill.

[21] Appl. No.: 521,312

[22] Filed: Aug. 29, 1995

[51] Int. Cl.[6] ..... B61D 45/00

[52] U.S. Cl. ..... 105/355; 105/374; 105/404; 267/140; 52/718.05; 24/662

[58] Field of Search ..... 105/355, 374, 105/378, 392.5, 404, 424; 403/363, 397; 293/128; 24/453, 662; 410/4, 66; 267/140; 411/44.5, 49, 57, 508; 52/288, 716.1, 716.4, 717.01, 718.05, 718.02

[56] References Cited

U.S. PATENT DOCUMENTS

| | | | |
|---|---|---|---|
| 3,865,358 | 2/1975 | Butters | 293/128 |
| 4,555,885 | 12/1985 | Raymond et al. | 52/468 |
| 4,913,061 | 4/1990 | Youngblood | 105/355 |
| 4,946,727 | 8/1990 | Kessler | 52/718.05 |
| 4,964,347 | 10/1990 | Long et al. | 105/355 |
| 4,974,900 | 12/1990 | Destefani et al. | 105/397 |
| 5,003,673 | 4/1991 | Nysten | 24/662 |
| 5,014,934 | 5/1991 | McClaflin | 52/718.05 |
| 5,096,753 | 3/1992 | McCue et al. | 293/128 |
| 5,239,933 | 8/1993 | Murphy et al. | 105/374 |
| 5,311,823 | 5/1994 | Rudibaugh et al. | 105/355 |
| 5,415,108 | 5/1995 | Murphy et al. | 105/374 |

*Primary Examiner*—S. Joseph Morano
*Attorney, Agent, or Firm*—Lloyd L. Zickert; Adam H. Masia

[57] ABSTRACT

An improved gap sealing device for covering the gaps between horizontally extending and vertically spaced apart sidewall panels on auto rack railroad cars and between sidewall panels and supporting members. The gap sealing device is a single piece of extruded plastic having a head attachable to a flange of a sidewall panel and a tail or flap for biasing against the vertically adjacent sidewall panel, and a body that covers the gap to prevent air passage. The head includes inside and outside walls where the inside wall is hingedly attached to the outside wall by a live hinge and movable between open and closed positions to facilitate attachment of the head to the flange of the sidewall panel. A spring clip is placed over the inside and outside walls of the head to maintain and lock the gap sealing device on the flange of the sidewall panel. The gap sealing device may also be used to close the gaps between the sidewall panels and the roof, the floor, and vertical posts of the auto rack railroad car.

54 Claims, 7 Drawing Sheets

AUTO RACK PANEL GAP SEALING DEVICE

DESCRIPTION

This invention relates in general to a device for closing air gaps in auto rack railroad cars to protect the vehicles being transported from being damaged by air-carried contaminants, and more particularly to an improved device which is adapted to be securely attached to the sidewall panels of an auto rack railroad car and for covering, closing, and sealing the gaps or openings between adjacent sidewall panels and/or between the sidewall panels and adjacent members.

BACKGROUND OF THE INVENTION

Heretofore, it has been common practice to transport newly manufactured vehicles, such as automobiles, vans, and trucks, made in this country or imported into this country, on auto rack equipped railroad cars. The transportation of newly manufactured vehicles by railroad is usually over long distances above three hundred miles. For example, domestic vehicles manufactured in the Midwest are transported to the west coast, or in another example, imported vehicles manufactured abroad which arrive on the west coast are transported to midwestern cities. A train having auto rack equipped railroad cars, known in the industry as auto rack cars, can take several days to reach its destination while traveling over thousands of miles through varying terrain. These trains also travel throughout the year enduring the severest of winter and summer weather as well as other environmental and man-made conditions.

The typical auto rack car is compartmented, having two or three floors or decks, opposed side walls, doors in front and back or at each end, and a roof. The side walls are constructed of numerous sidewall panels made of galvanized steel which are vertically arranged and attached between vertical posts that are spaced evenly throughout the length of the auto rack car. The sidewall panels are installed with horizontally extending gaps or openings between vertically adjacent panels, between the panels and the floor, roof or auxiliary panels, and between auxiliary panels and the floor. The cars are also constructed with vertically extending gaps or openings between the sidewall panels and the roof-supporting members such as the vertical posts. These gaps permit the entry of rapidly moving air into the auto rack car and thus onto and around the newly manufactured vehicles being carried in transit. This rapidly moving air entering the auto rack car carries airborne contaminants, such as iron oxide, smoke or exhaust from the railroad engine, metal filings or shavings from the railroad tracks, dirt or sand that may carry chemicals such as fertilizer, acid rain, and other precipitation containing contaminants, all of which can damage the finishes of the newly manufactured vehicles. This damage can be so extensive that the manufacturer has to specially coat the vehicles prior to shipment and/or repaint or refinish the vehicles after shipment.

One device for covering, closing, and sealing the gaps between adjacent sidewall panels as well as the gaps between the sidewall panels and the roof, vertical posts, floors, and auxiliary panels on an auto rack car is a gap sealer having a substantially rigid attaching head which is adapted to be snapped onto the flange of the sidewall panel, a covering body, and a sealing tail. This type of device heretofore known is disclosed in U.S. Pat. Nos. 5,239,933 and 5,415,108, which patents are owned by ZefTek, Inc., the owner of this application. Another known device is disclosed in U.S. Pat. No. 5,311,823.

The device disclosed in U.S. Pat. Nos. 5,239,933 and 5,415,108 involves a substantially rigid U-shaped attaching head having inside and outside walls. The interior surfaces of inside and outside walls may have gripping teeth attached thereon for frictionally engaging the flange of a sidewall panel to maintain the gap sealer on the panel. A covering body and a sealing tail are attached to the inside wall of the attaching head for covering the gap and biasing against an adjacent sidewall panel, vertical post, floor, roof, or auxiliary panel. In a further embodiment, U.S. Pat. Nos. 5,239,933 and 5,415,108 disclose an attaching head including inside and outside walls having a securing tongue attached to the outside wall and a coacting locking arm attached to the inside wall to additionally secure the gap sealing device on the flange of the sidewall panel.

While the device disclosed in U.S. Pat. Nos. 5,239,933 and 5,415,108 generally performs its intended function, it has been found that in a significant number of cases, the device disclosed therein, and specifically the embodiment of FIGS. 5 to 9, may become dislodged from the flange of the sidewall panel if significant inward and/or upward force is applied to a bumper attached to the device or to the covering body. It has also been found that if the flange of the sidewall panel is bent or deformed, it is extremely difficult to place the attaching head of the device on that flange. These flanges may become bent or deformed, for instance, if a vehicle door contacts them with sufficient force. Attaching the securing tongue and locking arm of FIGS. 10 to 13 of U.S. Pat. Nos. 5,239,933 and 5,415,108 does not necessarily solve the problem because it has been determined that that embodiment is more difficult to mount.

SUMMARY OF THE INVENTION

The present invention overcomes the above problems in providing an improved gap sealing device that is easily attachable to the flange of a sidewall panel and which prevents the gap sealing device from being become dislodged from the sidewall panel while covering, closing, and sealing the gap between adjacent sidewall panels. The present invention may also be used to cover the gap between a sidewall panel and the roof, vertical post, floor, or auxiliary panel. By closing these gaps, the inside of the auto rack car is protected against entry of high-velocity air which carries damaging contaminants.

The improved gap sealing device of the present invention includes a single piece of plastic, such as vinyl, or other suitable material which is extruded into a preformed shape and generally has an attaching head, a covering body, and a sealing tail or panel connecting means. The attaching head includes inside and outside walls which are hingedly attached to each other by a live hinge. The outside wall is accordingly movable relative to the inside wall between open and closed positions. The gap sealing device is preferably extruded in the closed position and is opened prior to placement on the sidewall panel flange. The live hinge is extruded with a memory characteristic that biases the outside wall toward the closed position. Alternatively, the gap sealing device may be extruded in the open position. To secure the attaching head of the device to the flange of the sidewall panel, the outside wall of the head is placed and held in the open position and the device is moved horizontally toward the flange. When the inside wall of the attaching head contacts or engages the flange, the outside wall is rotated in accordance with the memory of the live hinge to the closed position. The present invention also includes an inverted U-shaped spring clip which snaps or fits over the inside and outside walls of the attaching head. Thus, after positioning the attaching head in the closed position, the spring clip is snapped over the inside and outside walls, thereby coacting with the walls to securely attach and lock the attaching head to the sidewall panel. The present invention contemplates the use of different wall-engaging means on the clip, as described below.

When the attaching head is secured to the sidewall panel, the covering body attached to the inside wall of the attaching head covers the gap between the sidewall panel to which the attaching head is mounted and the adjacent sidewall panel. Likewise, the sealing tail or panel connecting means is attached to the covering body and may be formed in the same plane as the covering body or may be preformed in an angular position such that when the device is mounted, the sealing tail biases against the sidewall panel adjacent to the sidewall panel on which the attaching head is mounted or the panel connecting means engages the flange of the adjacent panel. Similar action occurs when the device is attached to the flange of the sidewall panel to close the gap between the sidewall panel and the roof, floor, vertical post, or auxiliary panel.

The device of the present invention can be made with various additional features, as described below. In one embodiment, the device may be made with an integral bumper which is co-extruded into a preformed shape. This bumper extends from the covering body into the auto rack car such that when a vehicle door is opened, the vehicle door contacts the plastic bumper instead of the metal sidewall panels and/or the roof. This bumper overcomes the vehicle door-damage problem associated with auto rack cars as explained in U.S. Pat. Nos. 5,239,933 and 5,415,108. In another embodiment, the device includes a panel connecting means, such as a scroll-shaped or accordion-shaped channel retaining member attached to the covering flap of the device which is adapted to be positioned in the channel of the flange on the lower or adjacent sidewall panel.

It is therefore an object of the present invention to provide a hinged gap sealing device which covers, closes, and seals the horizontal gaps between vertical sidewall panels on an auto rack car, thereby preventing air-carried contaminants from damaging the finishes of newly manufactured vehicles being transported in the auto rack car.

Another object of the present invention is to provide a gap sealing device with a hinged attaching head adapted to coact with a spring clip which is easily attachable to the flange of a sidewall panel and which prevents the device from becoming dislodged from the flange of the sidewall panel.

Another object of the present invention is to provide a hinged gap sealing device which may be easily installed from the inside of the auto rack car, thereby eliminating the need for scaffolding, ladders, or other such equipment in the installation which ultimately reduces overall installation time and increases safety.

Another object of the present invention is to provide a hinged gap sealing device with a bumper having the above advantages and whereby the bumper protects the vehicle doors from contacting the sidewall panels of an auto rack car.

A further object of the present invention to provide a hinged gap sealing device which is adapted to cover, close, and seal a gap between the sidewall panel and the roof, floor, vertical post, or auxiliary panel on an auto rack car, thereby preventing air-carried contaminants from entering the car and damaging the finishes of newly manufactured vehicles being transported in the auto rack car.

Other objects, features and advantages of the invention will be apparent from the following detailed disclosure, taken in conjunction with the accompanying sheets of drawings, wherein like reference numerals refer to like parts.

DESCRIPTION OF THE DRAWINGS

FIG. 15 shows the gap sealing device and spring clip in exploded view adjacent sidewall panel flanges;

FIG. 16 shows the scroll-shaped channel member which is attached to the tail positioned under the flange of the lower sidewall panel;

FIG. 17 shows the gap sealing device also positioned on the upper flange with the hinged attaching head in the open position;

FIG. 18 shows the attaching head in closed position with the spring clip mounted for securing the hinged attaching head to the flange of the upper sidewall panel;

DESCRIPTION OF THE INVENTION

The gap sealing device of the present invention solves the problem heretofore encountered when placing the device on a bent or malformed sidewall panel flange and preventing the device from becoming dislodged from the flange of the sidewall panel. Further, the present invention greatly enhances the mounting procedure, thereby reducing the time to install the device. The present invention accordingly better solves the problem of damage to the finishes of newly manufactured vehicles being transported in auto rack cars by significantly reducing the flow of air-carried contaminants into the auto rack car and across the vehicles.

Figure 1:
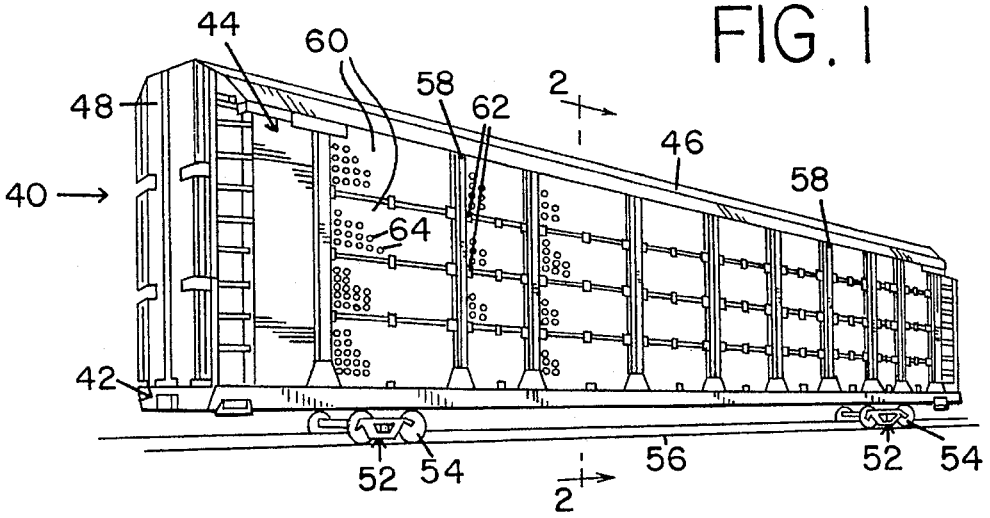
FIG. 1 is a perspective view of a typical auto rack car having a series of vertical posts on each side wall and four sidewall panels horizontally extending and vertically mounted between each pair of adjacent vertical posts.
Figure 2:
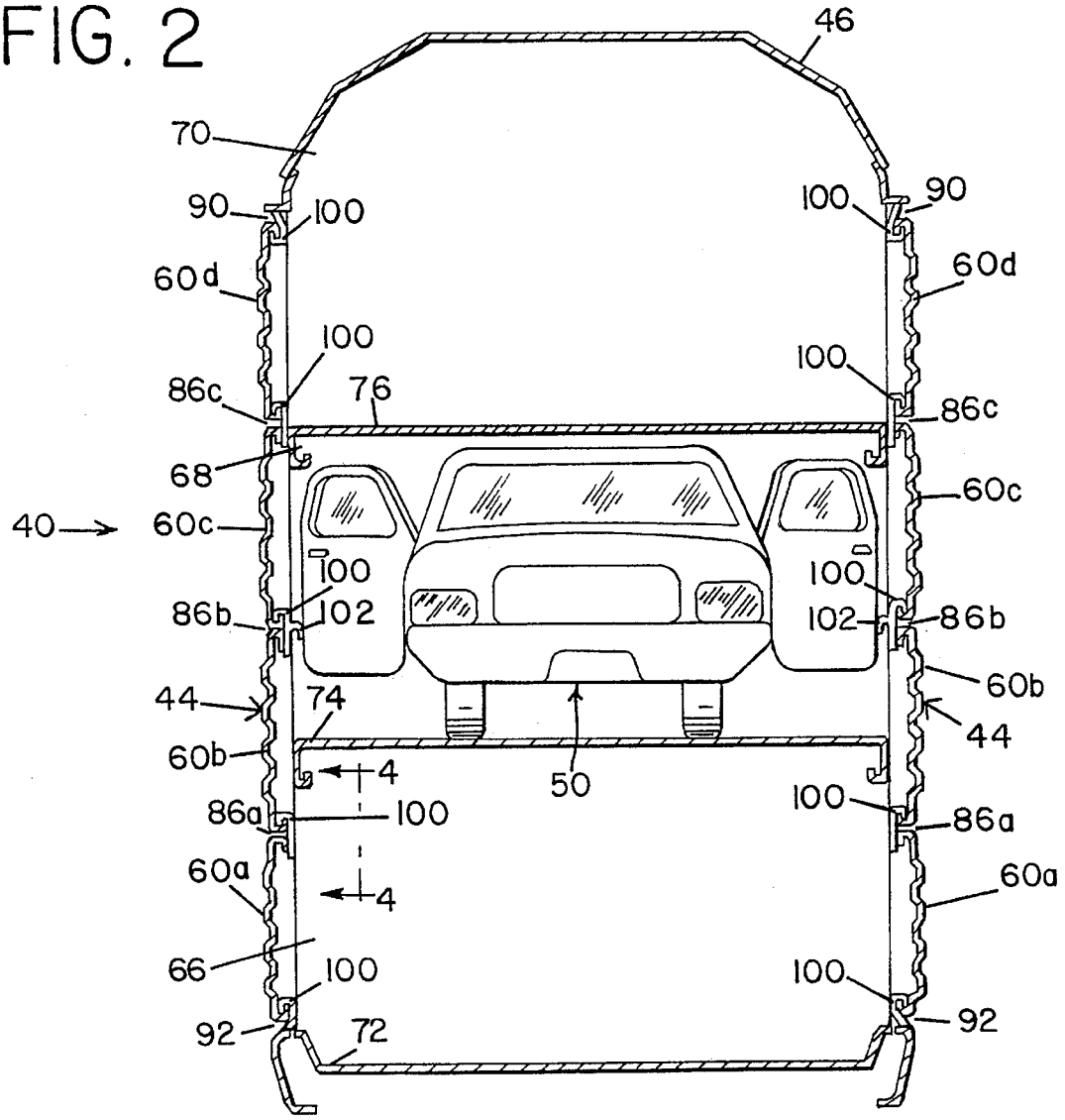
FIG. 2 is a cross-sectional view of the auto rack car in a tri-level configuration taken substantially along line 2—2 in FIG. 1 showing the placement of the hinged gap sealing device of the present invention.

Referring now to the drawings, and particularly to FIGS. 1 and 2, a typical auto rack car 40 includes a frame 42 which supports opposed side walls 44 and a roof 46. At each of the opposite ends of the auto rack car 40 are two pairs of doors 48. These doors 48 are opened during the loading and unloading of vehicles 50. The frame 42 is supported on trucks 52, each of which have several wheels 54 which roll along railroad tracks 56.

The side walls 44 include a series of steel vertical posts 58 which are mounted on and extend upwardly from the frame 42. The roof 46 is mounted on and supported by these vertical posts 58. The vertical posts 58 are evenly spaced along the entire length of both sides walls 44 of the auto rack car 40. A plurality of rectangular galvanized steel sidewall panels 60 extend horizontally and are vertically spaced apart between each pair of vertical posts 58. These sidewall panels 50 are supported at their corners by metal brackets 62 that are suitably secured to the vertical posts 58. Each sidewall panel 60 has a multiplicity of round sidewall panel holes 64 that are approximately five-eighths of an inch (16 mm) in diameter. These sidewall panel holes 64 provide the auto rack car 40 with natural light as well as proper ventilation. Proper ventilation allows toxic vehicle fumes generated by the vehicles during loading or unloading the vehicles 50 to be vented to the outside of the car, thereby protecting the persons driving the vehicles.

The auto rack car 40 illustrated in FIG. 2 is a tri-level car having first, second, and third levels 66, 68, and 70. The first level 66, the second level 68, and the third level 70 include first, second, and third level floors 72, 74, and 76, respectively, on which the vehicles 50 are supported. Normally, eighteen passenger vehicles can be transported in a tri-level auto rack car, six on each level.

Figure 3:
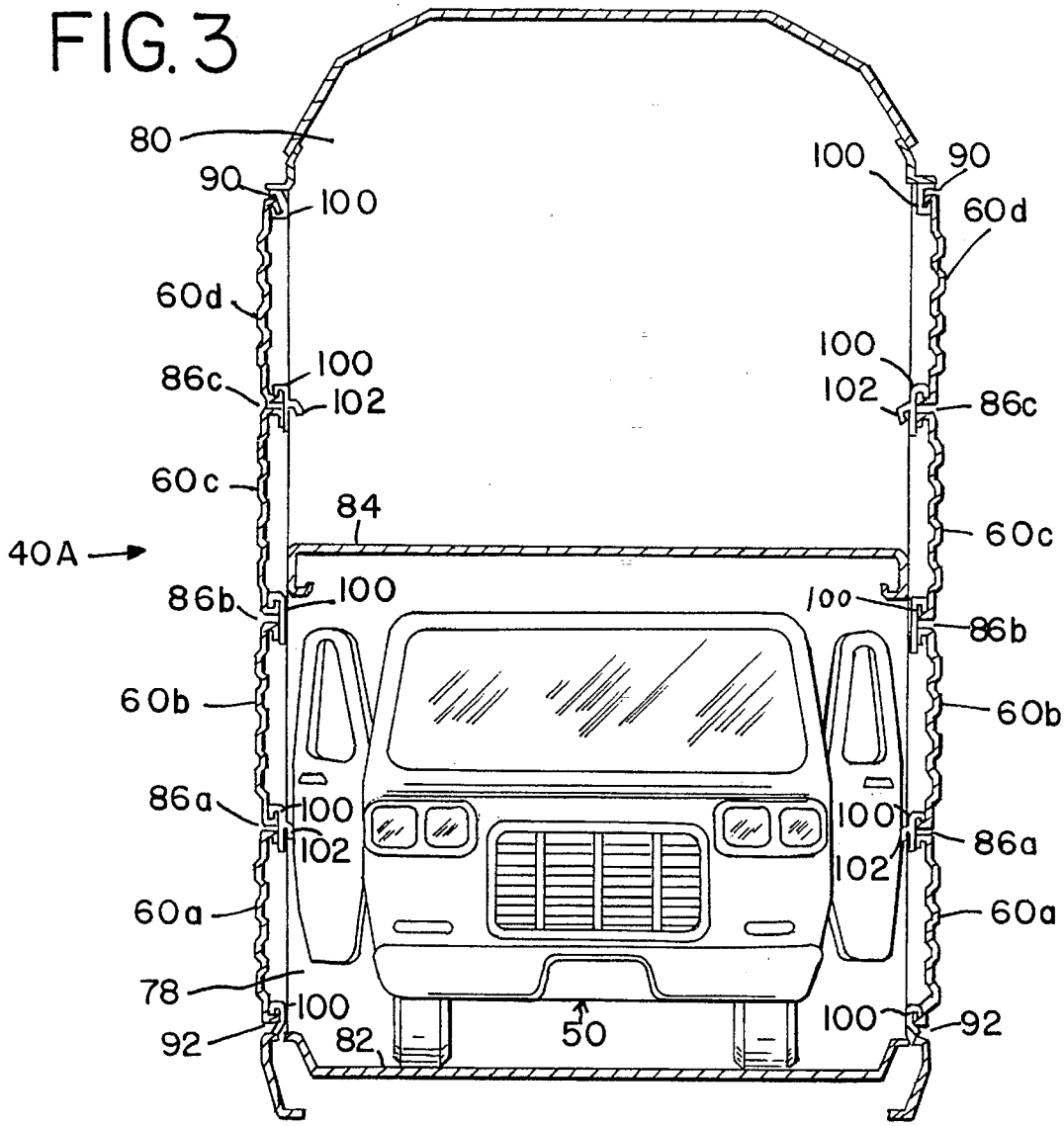
FIG. 3 is a cross-sectional view of an auto rack car in a bi-level configuration showing the placement of the hinged gap sealing device of the present invention.

The auto rack car 40A illustrated in FIG. 3 is a bi-level auto rack car which differs from the tri-level car 40 in that it includes two levels for vehicles instead of three. The bi-level auto rack car 40A has a lower level 78 and an upper level 80 which include lower and upper level floors 82 and 84 for supporting the vehicles. The bi-level auto rack car 40A is generally used to transport larger vehicles, such as vans, mini-vans, pickup trucks, and four-by-four vehicles. Also, as above mentioned, the bi-level auto rack car 40A can usually transport twelve of these vehicles 50, six on each level.

The sidewall panels, generally indicated by the numeral 60, on both the tri-level and bi-level cars are individually attached by the brackets 62 to the vertical posts 58 at each corner of each sidewall panel such that horizontally extending sidewall panel gaps 86*a*, 86*b* and 86*c* exist between adjacent sidewall panels. On the tri-level cars 40, the sidewall panel gap 86*a* on the first level 66 is the space between the lower two adjacent horizontally mounted sidewall panels 60*a* and 60*b;* the sidewall panel gap 86*b* on the second level 68 is the space between sidewall panels 60*b* and 60*c;* and the sidewall panel gap 86*c* on the third level 70 is the space between sidewall panels 60*c* and 60*d*. On the bi-level auto rack car 40A, the sidewall panel gaps 86 are identical except that gaps 86*a* and 86*b* are located on the lower level 78 and gap 86*c* is located on the upper level 80. These sidewall panel gaps 86*a*, 86*b*, and 86*c* generally vary in size from about one and a half inches to two and a half inches (37 to 51 mm), depending on the original construction, movement, and thermal expansion of the auto rack cars.

Although not shown, the tri-level and bi-level cars include gaps disposed between the sidewall panels and the vertical posts. These vertically extending gaps range from approximately one-half inch to one inch (12.7 to 25.4 mm). There are two vertically extending gaps, one on each side of the vertical post, and at each end of each sidewall panel. Both the tri-level and bi-level cars also include horizontally extending roof gaps 90 defined between the uppermost sidewall panels 60*d* and the roof 46. The roof gaps 90 range from about one-half inch to two and a half inches (12.7 to 63.5 mm). The tri-level and bi-level cars further include horizontally extending floor gaps 92 defined between the lowermost sidewall panels 60*a* and the floor 72 or 82, as illustrated in FIGS. 2 and 3. The floor gaps 92 range from about one-half inch to two and one-half inches (12.7 to 63.5 mm). Likewise, the tri-level and bi-level cars may also include horizontally extending auxiliary floor gaps defined between the lowermost sidewall panels and auxiliary panels and between the auxiliary panels and the floor. All of these gaps vary in size depending on the original construction, movement, and thermal expansion of the auto rack cars.

The auto rack cars are constructed with these gaps for several reasons. The sidewall panels and the vertical posts are galvanized steel. Hence, the sidewall panels and the vertical posts expand as the temperature increases and contract as the temperature decreases. The construction of the sidewall panels allows for this thermal expansion and contraction. As above mentioned, the auto rack car is constantly shimmying, swaying, twisting, and rocking when in transit. The construction of the vertical posts and the attachment of the sidewall panels allow for this movement without structural damage to the entire car. To date, there are at least 40,000 auto rack cars constructed in this manner and they continue to be manufactured in this manner.

All of these gaps, and especially gaps at the lower portion of the cars permit the entry of a significant amount of high-velocity air flow into and essentially throughout the auto rack car. On the other hand, the sidewall panel holes 64 do not permit the entry of a significant amount of high-velocity air flow into and throughout the auto rack car. The air flow generally passes over the sidewall panel holes, and any contaminants in air flowing through the holes usually drop to the floor because the velocity of the air flowing through these holes is so low. Controlling the velocity of air that enters and flows throughout the auto rack cars is important because air carries contaminants which can damage the finish of the newly manufactured vehicles.

There are numerous types of contaminants in the air. One particularly harmful type of contaminant is the tiny metal particles which are produced when the wheels of the auto rack car move along the railroad tracks. The wheels are generally made of a relatively harder steel than the railroad tracks. When the relatively harder wheels roll along the relatively softer railroad tracks, tiny metal particles are removed from the railroad tracks. Further, tiny particles are produced during braking by the wheels and the brake pads. Many of these tiny particles are carried by the air flow of the moving auto rack car into and through the auto rack cars through the gaps or openings around the sidewall panels. When these particles enter the auto rack car with a relatively high velocity air flow, they can settle upon the finish of the newly manufactured vehicles. Based on the temperature and humidity, these metal particles may begin to corrode or rust and thereby damage the finishes of the newly manufactured vehicles. This is similar to the phenomenon that happens to vehicles which are parked close to railroad tracks on a regular basis.

Similarly, another type of contaminant is the rust particles from the sidewall panels. Although the steel sidewall panels are galvanized, after prolonged use, the sidewall panels begin to rust especially at the corners of the sidewall panel where the brackets may directly contact the sidewall panels and thus produce air-borne rust particles. The rust particles are carried into the auto rack car by the air and may eventually settle on the newly manufactured vehicles in transit. Like the tiny metal particles, the rust particles can damage the finish of the newly manufactures automobiles, depending on the temperature and humidity.

Another type of contaminant is the chemicals contained in the exhaust from the engine of the train, acid rain and other precipitation, and dirt or sand containing fertilizer and/or other chemicals. These chemical contaminants can also be carried by the high-velocity air flow into the auto rack car through the gaps. Once in the auto rack car, these chemicals can settle on the newly manufactured vehicles and tend to dull or damage their finishes.

Finally, a further contaminant is the moisture carried in the air which is carried into the auto rack cars. This moisture acts as a catalyst for the metal particles, the rust particles, and the chemicals mentioned above.

To reduce the entry of these contaminates into the auto rack car, the velocity of the air flow into and throughout the auto rack car from the air gaps should be reduced or eliminated. If the air flow inside of the auto rack car is reduced to below a threshold level, the entry of such contaminates will be significantly reduced and the finishes of the newly manufactured vehicles will be preserved.

As illustrated in FIGS. 2 and 3, the hinged gap sealing device of the present invention, generally indicated as 100, can be made with or without a bumper 102. On both levels 78 and 80 of the bi-level car and on the second level 68 of the tri-level car, the sidewall panel gaps are located at approximately the same height as the vehicle door 51. Accordingly, the hinged gap sealer 100 with a bumper 102 is recommended for use on both sides of the auto rack car 40 to cover, close, and seal these gaps to prevent the flow of air through these gaps as well as to protect the vehicle door 51 from contacting the sidewall panels 60. On the other hand, on the first and third levels 66 and 70 of the tri-level car, the hinged gap sealing device 100 without a bumper would be used because the sidewall panel gaps 86*a* and 86*c* are not located at the approximate height of the vehicle door 51.

The improved gap sealing device 100 of the present invention may also be used to seal the vertically extending gaps at the posts, horizontally extending roof gaps, horizontally extending floor gaps, and horizontally extending auxiliary floor gaps. It should be appreciated that all of these devices can be installed by a person inside of the auto rack car standing on the floor at the appropriate level. Since scaffolding, ladders, and lifts are not required to install these devices, safety is significantly increased and the time necessary to install these devices is minimized. The improved gap sealing device 100 may also be installed on the sidewall panels during the construction or refurbishing of the auto rack cars before installation of the sidewall panels.

Referring now to FIGS. 4 to 10, this embodiment of the gap sealing device 100 of the present invention generally includes an attaching or clamping head 104 having an inside wall 106 hingedly attached to an outside wall 108, a securing tongue 110 attached to the outside wall 108, a covering body 112 attached to the inside wall 106, a locking arm 114 connected to the inside wall 106 and extending outwardly, and a sealing tail 116 attached to the covering body 112.

An inverted U-shaped spring clip or clamp 118 having opposed inside and outside legs 120 and 122 is provided to lock the attaching head to a sidewall panel flange. In this first embodiment, the legs 120 and 122 of the clip 118 have opposing teeth 128 and 130 on their inner surfaces which are adapted to securely grip the inside and outside walls of the hinged attaching head. The spring clip 118 thereby coacts with the hinged attaching head 104 to secure the attaching head on the flange of the sidewall panel, as further described below.

Figure 5:
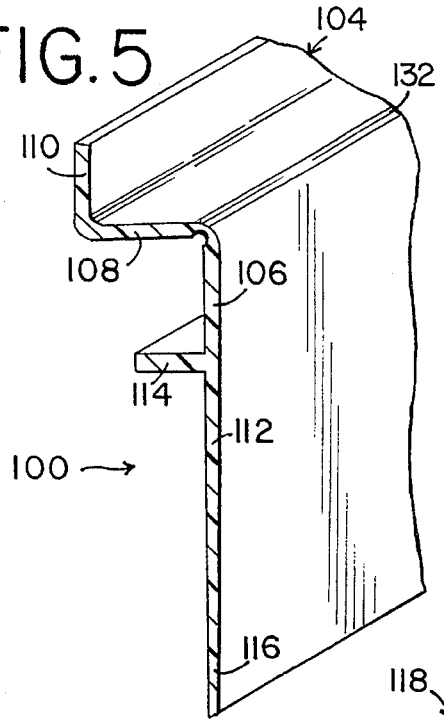
FIG. 5 is a fragmentary perspective view of the gap sealing device of the present invention in the open position and illustrating the hinged attaching head in open position, the securing tongue, the locking arm, the covering body, and the sealing tail.
Figure 7:
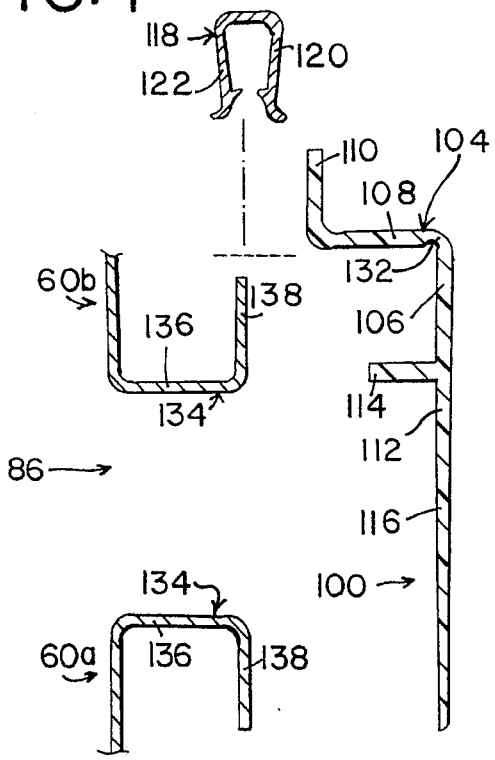
FIG. 7 is an exploded cross-sectional view of the gap sealing device and spring clip prior to mounting on fragmentary illustrated adjacent sidewall panels.
Figure 6:
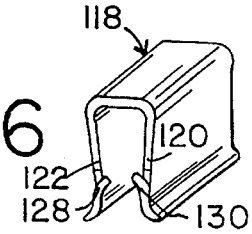
FIG. 6 is a perspective view of the spring clip of the present invention used to secure the gap sealing device to the flange of the sidewall panel.
Figure 8:
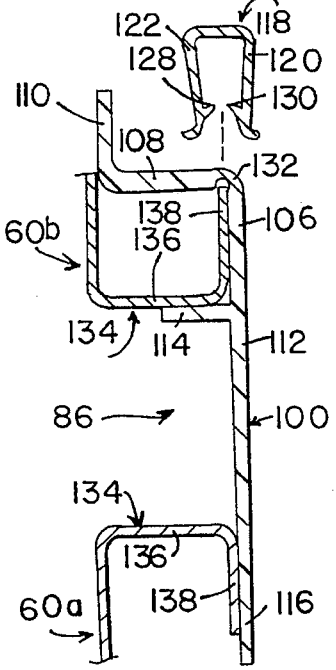
FIG. 8 is a view similar to FIG. 7, and showing the gap sealing device of the invention with the hinged attaching head on the upper sidewall panel in open position with the spring clip positioned for mounting.
Figure 9:
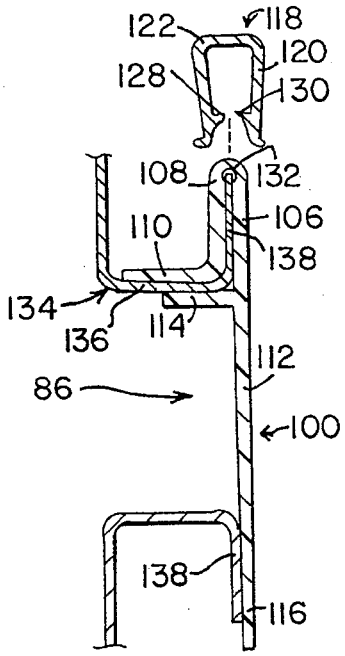
FIG. 9 is a view similar to FIG. 8, and showing the gap sealing device with the hinged attaching head on the upper sidewall panel in closed position.
Figure 10:
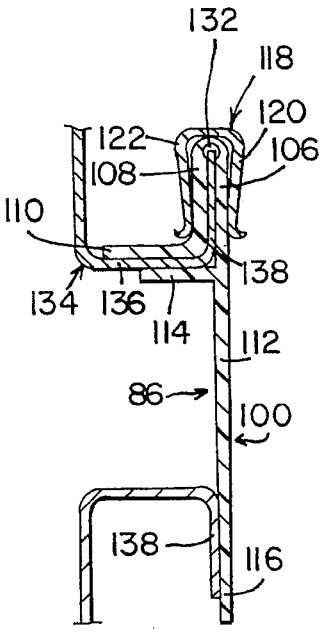
FIG. 10 is a view similar to FIG. 9, and showing the gap sealing device mounted on the sidewall panel with the spring clip mounted on and securing the hinged attaching head to the flange of the upper sidewall panel.

More specifically, the outside wall 108 of the attaching head is hingedly connected to the inside wall 106 by a live hinge 132 extruded from the same material as the inside and outside walls of the attaching head but having a thinner wall. The outside wall 108 is movable or rotatable relative to the inside wall 106 between an open position as shown in FIGS. 5, 7, and 8 and a closed position as shown in FIGS. 9 and 10. Preferably, the outside wall 108 is extruded in the closed position and accordingly obtains a memory characteristic which biases the outside wall toward the closed position. However, it could be extruded in the open position if desired. The attaching head 104 is adapted to be secured to a flange of one of the adjacent sidewall panels 60*a* and 60*b* which are horizontally corrugated and which have an L-shaped flange 134 extending at the periphery of the panel. The construction of the attaching head 104 of the gap sealer 100 is based on the presence of the upper and lower adjacent flanges of two adjacent vertically spaced sidewall panels. Each L-shaped flange 134 has a first leg 136 which is connected to the corrugated body of the panel and which extends generally horizontally into the car substantially perpendicular to that body. A second leg 138 is connected to the first leg 136 and extends substantially perpendicular to the first leg 136 and is thus substantially parallel to the body or face of the panel. In the flange of the upper sidewall panel, the second leg 138 extends upwardly and in the flange of the lower sidewall panel the second leg 138 extends downwardly.

To mount the attaching head 104 on the second leg 138 of the flange 134 of the upper sidewall panel, the attaching head 104 is rotated to or placed and held in the open position and generally vertically aligned with opposing flanges as shown in FIG. 7. The attaching head 104 and the entire gap sealing device 100 is then moved horizontally toward the flange 134 until the inside wall 106 contacts the second leg 138 of the flange 134 of the upper sidewall panel and the sealing tail 116 contacts the second leg 138 of the opposing flange 134 on the lower sidewall panel, as shown in FIG. 8. The outside wall 108 and the securing tongue 110 are then rotated in accordance with the memory of the live hinge to the closed position where the outside wall 108 engages the opposite surface of second leg 138 and the securing tongue engages the upper surface of the first leg 136, as shown in FIG. 9. Simultaneously, the locking arm 114 engages the lower surface of the first leg 136.

Figure 4:
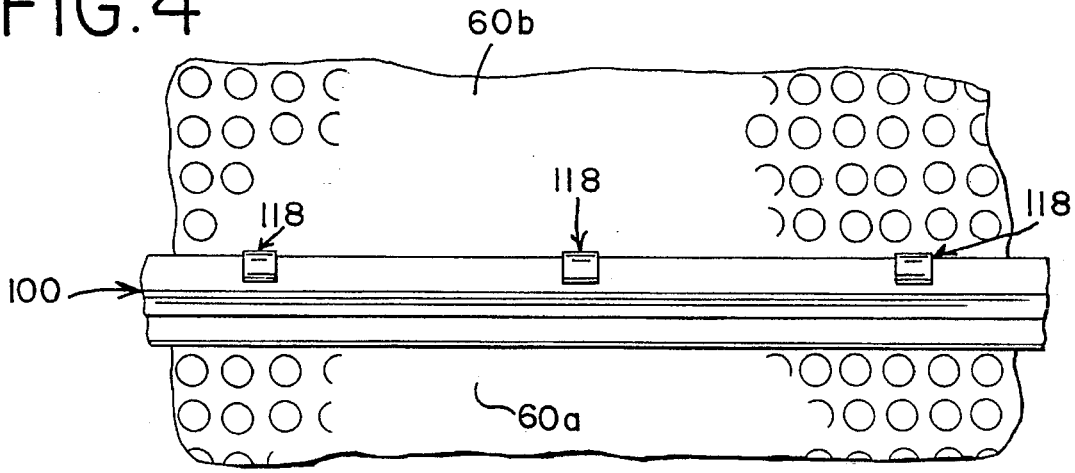
FIG. 4 is an enlarged fragmentary side elevational view of a section of the auto rack car taken from the inside of the car and substantially along line 4—4 in FIG. 2 and showing the placement of the gap sealing device and the spring clips of the present invention on a sidewall panel to cover the gap or opening between two adjacent sidewall panels.

The inverted U-shaped spring clip 118 is then snapped over the live hinge and the inside and outside walls of the attaching head to secure the head to the flange 134. The legs 120 and 122 of the clip biasingly engage the inside and outside walls 106 and 108 and securely attach the inside and outside walls to the second member 138 of the flange 134. The ends of both legs of the clip are flared out to facilitate easy placement of the clip over the attaching head whereby the teeth 128 and 130 of the clip frictionally engage or bite into the inside and outside walls of the attaching head, as best seen in FIG. 10. The force of the clip on the inside and outside walls cause those walls to frictionally engage the second leg of the flange. A plurality of spring clips 118, preferably made of stainless steel, are snapped into place along the attaching head at appropriate intervals along the head thereby securely attaching the gap sealer to the panel, as shown in FIG. 4. Alternatively, the clips may be made of a generally rigid but somewhat flexible plastic or other suitable material. If necessary, a rubber mallet or other similar tool may be employed to strike the clip and force it over the clamping head of the gap sealer by applying impact forces to the top of the clip. Also, if necessary, the gap sealing device 100 may be moved horizontally on the flange to adjust its placement along the sidewall panel.

The ability to place the gap sealing device 100 with a hinged attaching head on the flange from a vertically parallel position to the flange has numerous advantages over the device disclosed in U.S. Pat. Nos. 5,239,933 and 5,415,108, which reduces installation time, material costs, and labor costs. For instance, lubricant is not required to place the improved device on the flange. The gap sealing device 100 is also an improvement because it is mechanically locked in place, thereby providing better integrity with the sidewall panel and the entire car. The improved gap sealing device can also be easily placed on a flange in which the second leg 138 is bent or deformed and is thereby self-adjusting or self-compensating. Another advantage of the hinged clamping head is the ability to place the securing tongue at the end of the outside wall of the attaching head without inhibiting the installation of the gap sealing device. The securing tongue 110, when mounted in the closed position, contacts the upper surface of the first leg 136 of the flange 134 and coacts with the locking arm 114 which contacts the lower surface of the first leg 136 to assist in securing the attaching head to the upper sidewall panel. The locking arm extends from the inside wall of the gap sealing device toward the outside of the auto rack car 40 and securely engages the lower surface of the first leg 136 of the flange 134 to prevent upward movement of the gap sealing device. The combination of the inside wall, outside wall, and spring clip, as well as the securing tongue and locking arm, provide maximum strength in the attachment of the head of the gap sealing device to the flange and thus prevents accidental displacement of the device from the flange of the sidewall panel. The hinged construction of the clamping head facilitates an extremely tight fit between the locking arm 114 and the inside wall wherein the distance between the top of the locking arm 114 and the bottom of the live hinge 132 is preferably only slightly larger than the height of the second leg 138 of the flange 134. This fit is achieved without creating installation problems. Other advantages of the hinged gap sealing device will be apparent from the description below.

The covering body 112 attached to the clamping head 104 is sized to cover and close the sidewall panel gap 86 between the two adjacent horizontally extending sidewall panels. By covering and closing the sidewall panel gap, the high-velocity air carrying contaminants cannot enter the auto rack car 40 through that gap. The covering body 112 extends from and is connected to the end of the inside wall 106 opposite the live hinge 132. The covering body may extend along and in the same plane as the inside wall 106 lies or may extend at an angle, such as approximately a five-degree angle, from the inside wall for biasing purposes against the adjacent sidewall panel.

The sealing tail or flap 116 which is attached to the covering body at the end opposite the attaching head 104 may extend in the same plane as the covering body lies or may extend at an angle from the covering body 112. For biasing purposes the sealing tail 116 may be constructed, for instance, at approximately a seven-degree angle from the plane in which the covering body 112 lies or at approximately a twelve-degree angle from the plane in which the inside wall 106 lies. These angles are formed when the gap sealing device is extruded. The sealing tail and the covering body may be formed with these angles to better bias in sealing engagement against the opposing sidewall panel. The angled sealing tail and the covering body provide pressure to generally seal the gap when the gap sealing device is mounted on a panel because it is mounted against the angle and the memory of the material. Thus, it constantly exerts pressure by tending to return to its naturally formed extruded position. It should be appreciated that other angles, including zero-degree angles, for constructing the covering body and the sealing tail can be used and such angles can depend on the rigidity of the material used as well as other factors. The gap sealing device can also be constructed such that the sealing tail smoothly curves toward the outside wall, instead of having one or more bends which angle toward the outside wall.

The gap sealing device of the present invention is preferably made from a single piece of extruded plastic, and preferably the attaching head is extruded in the closed position as noted above. The attaching head of the gap sealing device may also be extruded in the open position or in an intermediate position. Of course, if made in the closed or intermediate positions, the outside wall must be rotated to the open position prior to placement on the sidewall panel. The securing tongue, the outside wall, the inside wall, the locking arm, the covering body, and the sealing tail of the gap sealing device are preferably made from an extrudable grade (low-density) polyethylene with some memory qualities, and specifically a somewhat rigid polyethylene. The live hinge may likewise be extruded from the same material but having a substantially thinner section at the bottom or top of the hinge to allow flexibility of the hinge. Alternatively, the gap sealing device may be made other suitable extrudable plastic materials, such as polyvinyl chloride (PVC), rubber, or urethane. The use of a single material in making the device is cost-efficient and facilitates recycling of the device.

The gap sealing device 100 may also have a UV inhibitor incorporated in a gray color containing one-tenth of one percent of a hindered amine light stabilizer. The UV inhibitor prevents the deterioration of the device from ultraviolet rays. Other UV inhibitors could be used in the device. It should also be appreciated that since the device is mounted inside the auto rack car instead of on the outside, it is at least partially protected from the damaging ultraviolet rays.

Figure 11:
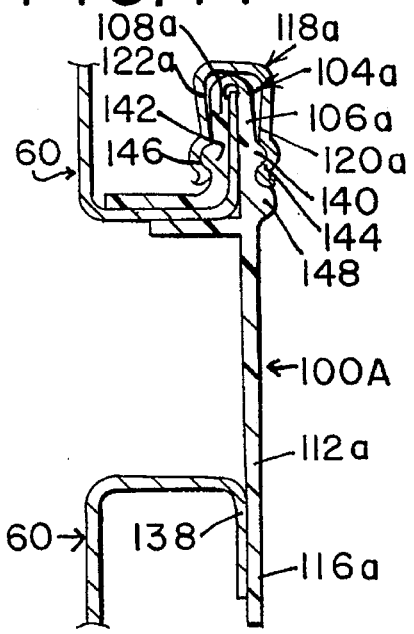
FIG. 11 is a cross-sectional view of a further embodiment of the invention, illustrating opposing locking bars on the inside and outside walls of the hinged attaching head, a clip protection bar on the inside wall, and a modified spring clip having locking indents which coact with the locking bars.

Referring now to FIG. 11, a further embodiment of the combination gap sealing device and spring clip of the present invention is illustrated. This device is generally designated 100A and differs from the device 100 in that the inside and outside walls 106*a* and 108*a* of the attaching head 104*a* include horizontally extending opposing semi-circular locking bars 140 and 142 along their outer surfaces. The locking bars 140 and 142 are integrally extruded with the walls of attaching head 104*a* and preferably extend the entire length of the device. The spring clip 118*a* differs from spring clip 122 in that the teeth of the clip are eliminated and the inner surfaces of legs 120*a* and 122*a* of the spring clip 118*a* include horizontally extending opposing semi-circular locking indents 144 and 146 which are adapted to engage and coact with the corresponding locking bars or detents 140 and 142 to assure locking engagement of the clip 118*a* to the attaching head. Accordingly, the clip coacts with the inside and outside walls to secure the head to the flange, and thus the device to the sidewall panel. While the locking bars are semi-cylindrical or rounded in cross section, they may be polygonally shaped if desired, and the locking indents may be shaped corresponding to the locking bars, as further described below.

The gap sealing device 100A also includes a horizontally extending clip protection bar 148 positioned on the outer surface of the inside wall 106*a* and spaced below the locking bar 140. The clip protection bar 148 which extends further into the car than the flared portion of spring clip leg 120*a* to prevent a person or door from injury or damage caused by contact with the end of the flared portion of the clip.

As with gap sealing device 100, the covering body 112*a* of gap sealing device 100A covers the gap between the two sidewall panels 60, and the sealing tail 116*a* seals against the lower sidewall panel, and specifically against the second leg 138.

Figure 12:
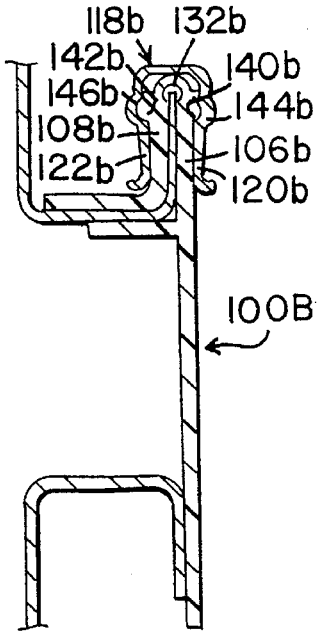
FIG. 12 is a cross-sectional view of a further embodiment of the invention, illustrating an alternative position for the opposing locking bars on a hinged attaching head not including the clip protector and a clip having correspondingly located locking indents.

Referring now to FIG. 12, a further embodiment of the gap sealing device and spring clip of the present invention is illustrated, and generally designated 100B, and differs from gap sealing device 100A in that the semi-circular horizontally extending opposing locking bars 140*b* and 142*b*, on the inside and outside walls 106*b* and 108*b*, similar to locking bars 140 and 142, are positioned closer to the live hinge 132*b* of the attaching head than in the embodiment of FIG. 11. The locking bars 140*b* and 142*b* coact with corresponding horizontally extending opposing semi-circular locking indents 144*b* and 146*b* on the inner and outer legs 120*b* and 122*b* of the spring clip 118*b* to facilitate securement of the walls to the flange. This embodiment also illustrates that while the clip protection bar is preferable, it is not mandatory for the operation of the gap sealing device of the present invention. It should be appreciated that the locking bars may be arranged at any suitable position on the attaching head and need not oppose each other. Likewise, only one locking bar may be utilized on either wall independently or in combination with locking teeth as in spring clip 118 on the opposite leg of the clip.

Figure 13:
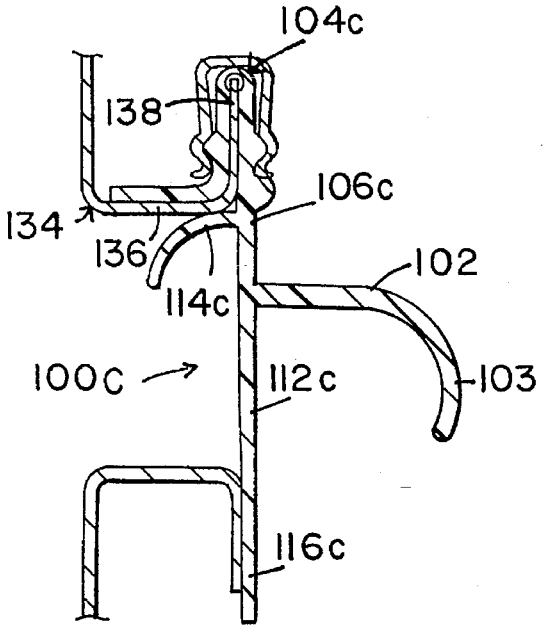
FIG. 13 is a cross-sectional view of a further embodiment of the invention, with the gap sealing device having a bumper extending from the covering body and a rounded locking arm.

A further embodiment of the gap sealing device of the invention, shown in FIG. 13 and generally indicated by the numeral 100C, differs from the embodiment of FIG. 11 in the shape of the locking arm 114*c* and the addition of bumper 102. The locking arm 114*c* extends outwardly from the inside wall 106*c* into the gap between panels and is in the form of a downwardly curving flap. The locking arm 114*c* directly contacts the underside of flange 134, at the corner where the first leg 136 and the second leg 138 are connected. This locking arm prevents the upward movement of the device 100*c* and assists in securing the attaching head 104*c* to the sidewall panel 60. The bumper 102 on the gap sealing device 100C prevents the vehicle doors from contacting the side walls. More specifically, the bumper 102 is connected to the covering body 112*c* approximately mid-way between the attaching head 104*c* and the sealing tail 116*c*. The bumper 102, which is of a tapered semi-rigid plastic having approximately the same durometer hardness rating as the gap sealing device, projects from the covering body 112*c* at a substantially perpendicular angle. The bumper 102 is generally arcuately shaped, tapered at its free end 103, and integrally extruded with the gap sealing device. The tapered free end 103 absorbs the impact forces and guards against contact with the sidewall panels. The construction of the gap sealing device 100C with the bumper 102 allows a person or a vehicle door to contact the bumper 102 instead of the sidewall panels without injury to the person or damage to the finish of the vehicle door.

Figure 14:
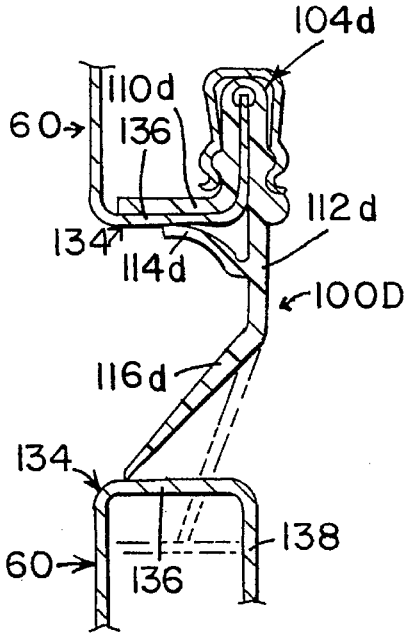
FIG. 14 is a cross-sectional view of a further embodiment of the invention, and having a modified locking arm and a modified sealing tail.

A further embodiment of the gap sealing device, shown in FIG. 14 and generally indicated by the numeral 100D, differs from the gap sealing device 100A of FIG. 11 in the shape of the locking arm 114*d* and the angle of the sealing tail 116*d*. The locking arm 114*d* is attached to the covering body 112*d* intermediate the attaching head 104*d* and the sealing tail 116*d* and extends into the gap and is curved upwardly toward the flange 134 of the upper panel. The unattached end of the locking arm 114*d* engages the lower surface of the first leg 136 of the flange 134 on the upper sidewall panel 60 to prevent substantial upward movement of the gap sealing device and to further coact with securing tongue 110*d* to assist in securing and properly positioning the attaching head 104*d* to the flange. The sealing tail 116*d* is formed at an angle to engage the lower sidewall panel 60 and particularly the upper surface of the first leg 136 of the flange 134 of the lower sidewall panel 60 instead of the second leg 138 of the flange 134. The placement of this sealing tail is easily accomplished due to the hinged construction of the attaching head and the easy placement of that head on the flange of the upper sidewall panel. More specifically, the sealing tail 116*d* is attached to the covering body 112*d* at an approximately 15-degree angle from the plane in which the covering body 112*d* lies. This angle is formed when the gap sealing device is extruded. The sealing tail provides pressure on the first leg 136 of the lower sidewall panel flange to seal the gap because it is mounted against the angle and the memory of the material. Thus, it constantly exerts pressure by tending to return to its naturally formed extruded position, as shown in phantom in FIG. 14. It should be appreciated that other angles for constructing the covering body and the sealing tail can be used and such angles can depend on the rigidity of the material used as well as other factors. FIG. 14 also illustrates in phantom the position and sealing effect of the sealing tail on the lower sidewall panel when the gap between the panels increases to its maximum distance.

Figure 15:
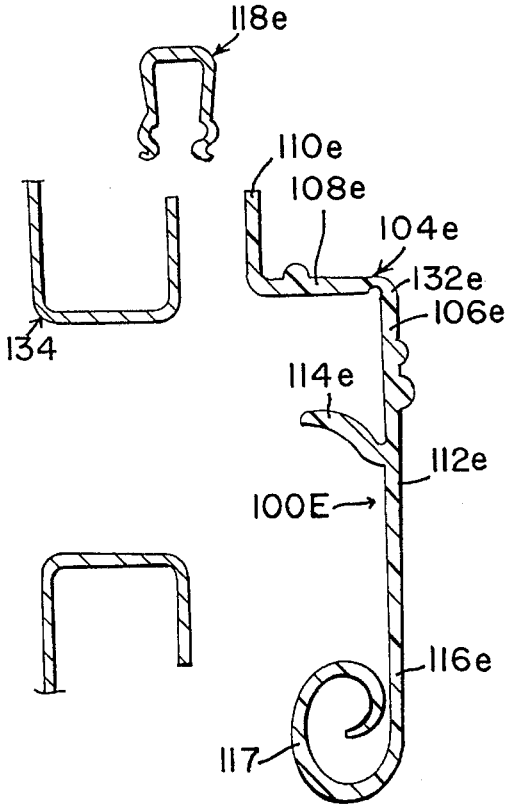
FIGS. 15 to 18 are cross-sectional views of still another embodiment of the invention having a scroll-shaped channel member on the tail and showing the successive steps of mounting the gap sealing device on the sidewall flange to cover the gap between the flanges.
Figure 16:
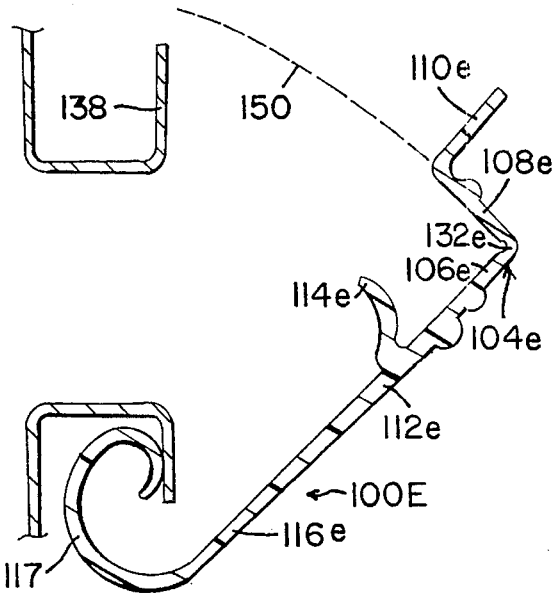
Figure 17:
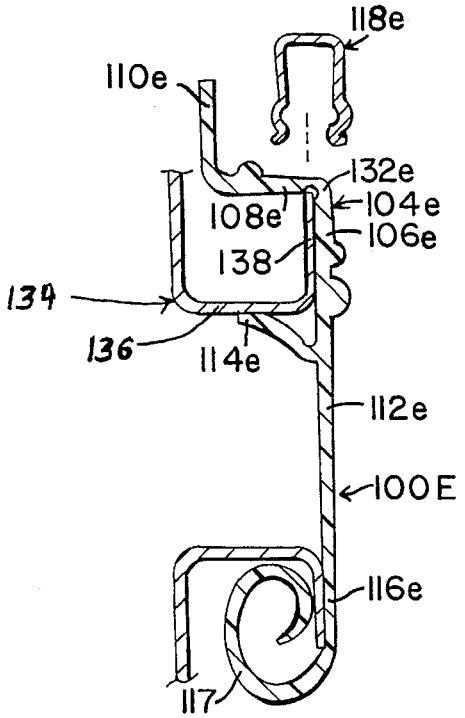
Figure 18:
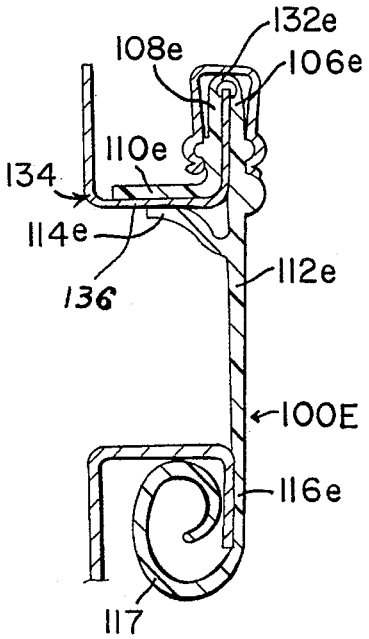

Another embodiment of the gap sealing device of the invention is illustrated in FIGS. 15 to 18, and generally indicated by numeral 100E. Like the device 100A in FIG. 11, the device 100E generally includes a hinged attaching head 104*e* having inside and outside walls 106*e* and 108*e* connected by a live hinge 132*e*, a securing tongue 110*e* attached to the outside wall 108*e*, a covering body 112*e*, a locking arm 114*e* attached to the covering body like locking arm 114*d* in FIG. 100D, a sealing tail 116*e*, and a spring clip 118*e*. However, gap sealing device 100E differs from the prior embodiments in that it has a tapered scroll-shaped channel member 117 attached to the sealing tail or flap 116*e* and which is adapted to be inserted into the channel formed by the flange of the lower sidewall panel. This scroll-shaped channel member 117 is extended integral with the covering body 112*e* and sealing tail 116*e* and is adapted to smoothly uncurl when the sidewall panels move away from each other and smoothly curl up when the panels move toward each other. To mount the gap sealing device 100E on adjacent sidewall panels, the attaching head 104*e* is placed in the open position, and the scroll-shaped channel member 117 is hooked under the lower sidewall panel flange, as shown in FIGS. 15 and 16. The attaching head 104*e* and the entire gap sealing device 100E is then rotated on that flange toward the flange of the upper sidewall panel, as indicated by the dotted line 150 in FIG. 16, and until the inside wall 106*e* contacts the second leg 138 of the flange of the upper sidewall panel, as shown in FIG. 17. The outside wall 108*e* and the securing tongue 110*e* are then rotated to the closed position where the outside wall 108*e* engages the second flange leg 138 and the securing tongue engages the upper surface of the first flange leg 136, as shown in FIG. 18. The inverted U-shaped spring clip 118*e* is then snapped over the inside and outside walls of the attaching head to secure the head to the flange 134 of the upper sidewall panel. Any suitable number of spring clips may be snapped into place along the attaching head at appropriate intervals. The live hinge construction of the attaching head of the present invention facilitates the use and easy placement of the scroll-shaped channel member 117. The scroll-shaped channel member is advantageous because it allows the sidewall panels to move toward or away from each other or to significantly expand or contract while maintaining the tail or flap of the device in sealing contact with the lower sidewall panel and thereby assuring closure of the air gap.

Figure 19:
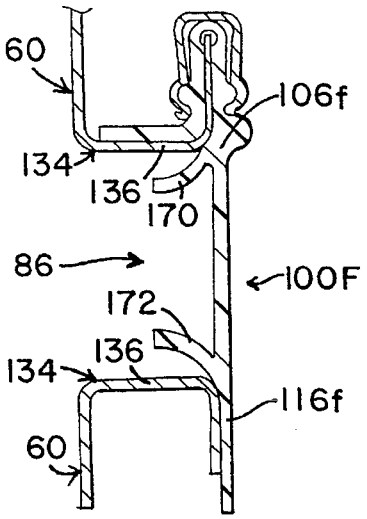
FIG. 19 is a cross-sectional view of a still further embodiment of the invention like FIG. 11 and where the gap sealing device includes a modified locking arm and modified sealing tail.

Referring now to FIG. 19, a further embodiment of the gap sealing device is illustrated. The device 100F differs from gap sealing device 100A in that the device 100F includes two curved extension members 170 and 172 which extend outwardly from the inside wall 106*f* and the sealing tail 116*f* into the gap 86 between the flanges 134 of the sidewall panels 60. These extension members assist in sealing the gap as the sidewall panels expand or move closer together by biasingly engaging the first leg 136 of both flanges 134 of the sidewall panels 60.

Figure 20:
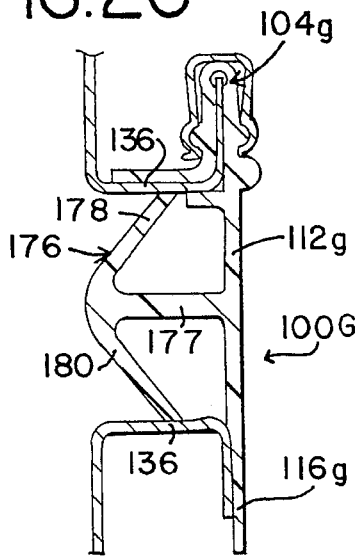
FIG. 20 is a cross-sectional view of an even further embodiment of the invention like FIG. 11 and where the gap sealing device includes an arrow-shaped insertion member extending into the gap.

Referring now to FIG. 20, a further embodiment of the gap sealing device is illustrated. The device of this embodiment is generally designated 100G and differs from gap sealing device 100A in that it includes an arrow-shaped extension member 176 connected to the covering body 112*g* approximately midway between the attaching head 104*g* and the sealing tail 116*g*. The extension member 176 which perpendicularly extends into the gap between the flanges of the sidewall panels includes an extension arm 177 and two sealing members 178 and 180 connected to the end of the extension opposite the end connected to the covering body 112*g*. Sealing member 178 extends upwardly at an approximately 45-degree angle toward the covering body and is adapted to contact the lower surface of the first leg 136 of the flange of the upper sidewall panel. Likewise, sealing member 180 extends downwardly at an approximately 45-degree angle toward the sealing tail and is adapted to contact the upper surface of the first leg 136 of the flange of the lower sidewall panel. The sealing members 178 and 180 thereby coact to further close the gap between flanges. A shortened locking arm 114*g* is perpendicularly attached to the outside surface of the inside wall 106*g* so as not to interfere with sealing member 178. The hinged attaching head of the present invention facilitates easy placement of this extension member 176.

Figure 22:
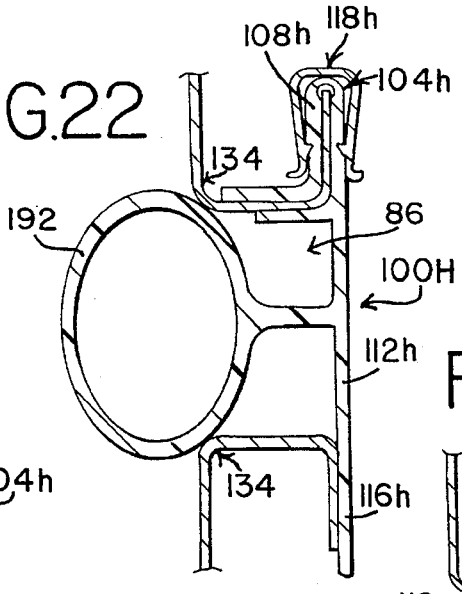
FIG. 22 is a cross-sectional view of the embodiment of FIG. 21 mounted on a sidewall panel with the oval tube-shaped extension member extending outside the car to further enhance sealing of the gap and retaining the tail in position against the lower sidewall panel.
Figure 21:
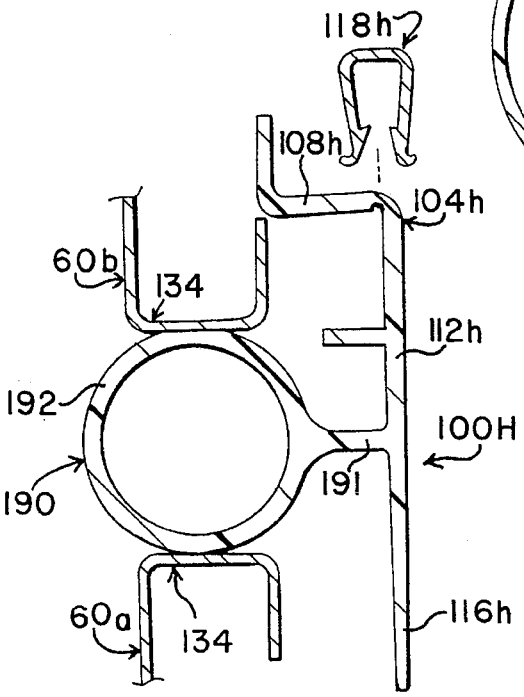
FIG. 21 is a cross-sectional view of a further embodiment of the invention like FIG. 11 having an oval tube-shaped insertion member illustrated in the intermediate position during mounting on the sidewall panel.

Referring now to FIGS. 21 and 22, a further embodiment of the gap sealing device is illustrated. The device of this embodiment is designated 100H and differs from the device 100 in that it includes an extension member 190 connected to the covering body 112*h* approximately midway between the attaching head 104*h* and the sealing tail 116*h*. The extension member 190 includes an extension arm 191 which perpendicularly extends into the gap between the sidewall panels 60 and an oval sealing tube 192 on the extension arm. Prior to placement, the gap sealing device 100H is positioned adjacent to the sidewall panel gap 86 as in previous embodiments. The device is then horizontally moved forward toward the panels and the oval tube 192 is squeezed into the gap, as seen in FIG. 21. In this intermediate position, the oval tube 192 may be squeezed into a substantially round shape between the sidewall panel flanges 134 depending on the size of the gap. As the device 100H is further moved to the fully mounted position, the tube 192 regains its oval shape and seals against the flanges 134 of the upper and lower sidewall panels 60*b* and 60*a*. The outside wall 108*h* is rotated to the closed position and the spring clip **118*h* is installed, as shown in FIG. 22. The oval tube further prevents air and contaminants from entering the car through the gap, as well as retaining the tail 116*h* in sealing contact with the lower sidewall panel flange. The hinged attaching head facilitates easy placement of the sealing tube 192 which would be significantly harder if not impossible with a substantially rigid attaching head. It should also be appreciated that this embodiment of the device is similar to the device 100 which shows teeth on the spring clip 118*h*** rather than the locking bars and indents. Either structure could be employed.

Figure 23:
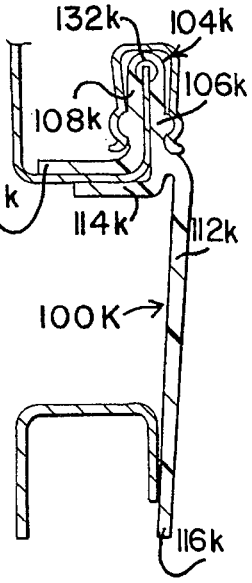
FIG. 23 is a cross-sectional view of a further embodiment of the invention wherein the sealing tail extends from the outer surface of the inside wall of the hinged attaching head.

Another embodiment of the gap sealing device is illustrated in FIG. 23 and generally designated 100K. Like the device 100A, the device 100K generally includes a hinged attaching head **104*k* having inside and outside walls 106*k* and 108*k* connected by a live hinge 132*k*, a securing tongue 110*k* attached to the outside wall 108*k*, and a locking arm 114*k* attached to inside wall 106*k*. The locking arm 114*k* extends perpendicularly from the inside wall 106*k* to create a tight fit on the flange. The gap sealing device 100K further includes a covering body 112*k* and sealing tail 116*k* which extends inwardly from the surface of the inside wall 106*k*** facing the inside of the auto rack car and then downwardly. More specifically, the covering body extends from the inside wall at the position where a protection bar may be located and thereby replaces the clip protection bar and operates to prevent a person inside the auto rack car from being injured by touching the clip.

Figure 24:
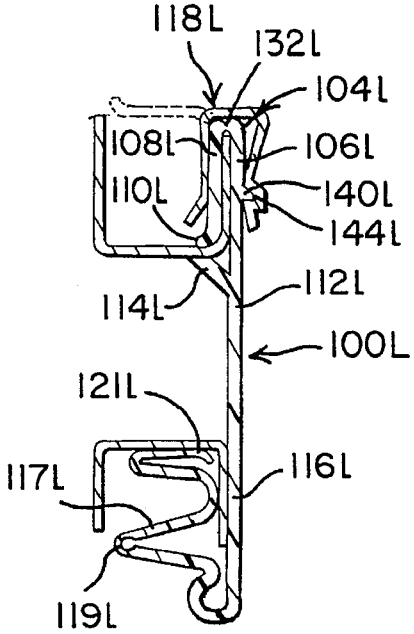
FIG. 24 is a cross-sectional view of a still further embodiment of the invention like FIGS. 15 to 18 and where the gap sealing device includes an upwardly extending locking arm and an accordion-shaped channel member attached to the sealing tail.

A still further embodiment of the gap sealing device of the present invention is illustrated in FIG. 24, and generally indicated by numeral 100L. The device 100L includes a hinged attaching head 104L having inside and outside walls 106L and 108L connected by a live hinge 132L, a shortened securing tongue 110L connected to the outside wall 108L, a covering body 112L connected to the inside wall 106L, an upwardly extending locking arm 114L connected to covering body 112L, a sealing tail or flap 116L connected to the covering body 112L, and an accordion-shaped channel member 117L connected to the sealing tail or flap 116L and coacting with the flange of the lower sidewall panel. The attaching head 104L includes a single three-sided locking bar or rib 140L on the inside wall 106L and a single corresponding locking indent 144L on the inner wall of the spring clip 118L. The opposite wall of the spring clip is formed or bent to biasingly engage the outside wall 108L of the attaching head 104L against the flange to maintain the hinged attaching head 104L locked on the flange, and thereby illustrating another form of the spring clip. The securing tongue 110L may be shortened, or eliminated if desired, to facilitate the use of a clip having a longer inner wall. The accordion-shaped channel member 117L functions in a similar manner to the scroll-shaped channel member of FIGS. 15 to 18. The accordion-shaped channel member allows the flanges to move significantly toward or away from each other while the sealing tail maintains the seal on the flange of the lower panel. The accordion-shaped channel member may be tapered or formed of a thinner material than the covering body for enhancement of its flexibility. One or more areas of reduced thickness 119L may be provided in the accordion-shaped channel member to provide further flexibility in the channel member. The end 121L of the channel member is also formed to engage the flange of the lower sidewall panel. The gap sealing device 100L is installed on the sidewall panels in the same manner as the device 100E in FIGS. 15 to 18. The hinged attaching head allows easy placement of the device with the accordion-shaped channel member on the flanges of the adjacent sidewall panels.

Figure 25:
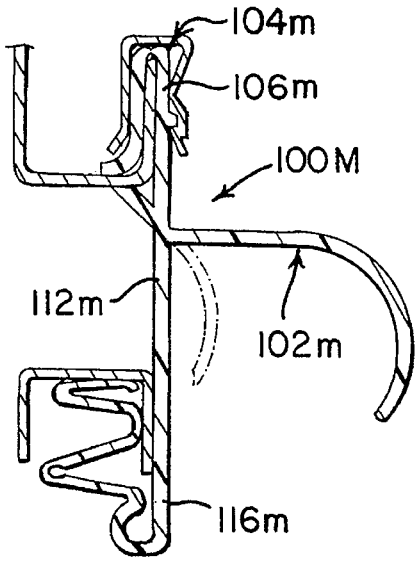
FIG. 25 is a cross-sectional view of a further embodiment of the invention like FIG. 24 and having a bumper extending from the covering body and an alternative bumper shown in phantom.

A further embodiment of the gap sealing device is illustrated in FIG. 25, and is generally indicated by numeral 100M. The device 100M differs from the device 100L only in that it includes a bumper **102*m* which extends into the auto rack car from the covering body 112*m* between the inside wall 106*m* of the attaching head 104*m* and the sealing tail 116*m*. This bumper functions like bumper 102 in FIG. 13 and is constructed in the same manner. Alternatively, the bumper may be of the form shown in phantom in FIG. 25**.

Figure 26:
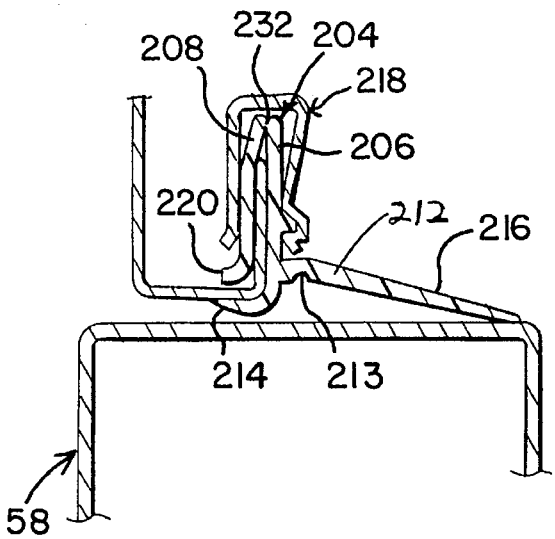
FIG. 26 is a horizontal cross-sectional view of a further embodiment of the invention where the gap sealing device is adapted to seal the gap between the sidewall panel and the vertical post.

A further embodiment of the present invention is illustrated in FIG. 26 which shows a vertical post gap sealing device 200 adapted to seal the gap between a vertical edge or flange of a sidewall panel and a vertical post 58. The vertical post gap sealing device 200 generally includes a hinged attaching head 204 having inside and outside walls 206 and 208 connected by a live hinge 232, a short securing tongue 220 attached to the bottom of the outside wall 208, a covering body 212 attached to the surface of the inside wall 206 facing the interior of the auto rack car, a tapered locking arm 214 attached to the inside wall 206, and a sealing tail 216. A spring clip 218, like that in FIG. 24, is adapted to secure the hinged attaching head to the flange of the sidewall panel. The tapered locking arm 214 is preferably constructed at approximately a 90° angle to the inside wall 206 for allowing the vertical gap sealing device to be used when the gap between the sidewall panel and the vertical post is extremely narrow. The covering body 212 is attached to the surface of the inside wall 206 at a right angle and is adapted to extend into the auto rack car. The covering body 212 has a corner area 213 of reduced thickness which provides for a rotatable sealing tail 216 to accommodate the vertical post 58 and to enable the vertical post gap sealing device to be used on various sized vertical gaps. More specifically, when the gap between the sidewall panel and the vertical post is extremely narrow, as shown in FIG. 26, the entire sealing tail rotates about the area 213 of reduced thickness and creates a seal against the vertical post.

Figure 27:
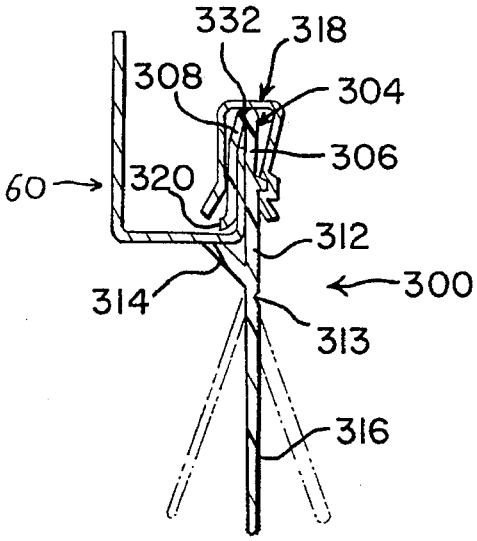
FIG. 27 is a cross sectional view of a further embodiment of the invention where the gap sealing device is adapted to seal the gap between the sidewall panel and the roof or the floor of the auto rack railroad car.

A still further embodiment of the present invention is illustrated in FIG. 27, which shows a roof or floor gap sealing device 300 adapted to seal the gap between a sidewall panel 60 and the roof (not shown) or between a sidewall panel and the floor (not shown). The roof or floor gap sealing device 300 generally includes a hinged attaching head 304 having inside and outside walls 306 and 308 connected by a live hinge 332, a short securing tongue 320 attached to the bottom of the outside wall 308, a covering body 312 attached to the inside wall 306, a locking arm 314 attached to the covering body 312 or inside wall 306, and a sealing tail 316 attached to the covering body 312. The covering body includes an area 313 of reduced thickness which provides for a rotatable sealing tail 313 to accommodate the roof or floor and to enable the floor or roof gap sealing device 300 to be used on various sized gaps. The reduced area facilitates the rotation of the sealing tail 316 in either direction, as shown in phantom. A spring clip 318, like that in FIG. 26, is adapted to secure the hinged attaching head to the flange of the side wall panel. The sealing tail 316 is flexible and formed to maintain a sealing relation against the roof or floor.

Although not shown, it should be appreciated that the inside wall and outside wall of the attaching head may include a series of gripping teeth, as illustrated in U.S. Pat. Nos. 5,239,933 and 5,415,108, which run throughout the length of the attaching head. These gripping teeth may additionally serve to grippingly secure the attaching head to the flange of the sidewall panel. The shape and construction of these gripping teeth could vary, and the gripping teeth may be made from the same material as the device or from a more flexible material than the rest of the device which could provide more friction on the sidewall panel flange and therefore grip the sidewall panel flange better. These teeth may be co-extruded with the body of the device so that they are integral with the body. It should also be appreciated that the gap sealing device of the invention could be installed upside-down. In other words, the attaching head could be connected to the flange of a lower sidewall panel and the sealing tail could bias against the adjacent upper sidewall panel.

It will be understood that modifications and variations may be effected without departing from the scope of the novel concepts of the present invention, but it is understood that this application is to be limited only by the scope of the appended claims.

The invention is hereby claimed as follows:

1. In an auto rack railroad car having opposed walls each including a plurality of horizontally extending and vertically spaced apart sidewall panels defining horizontally extending gaps between said sidewall panels, said sidewall panels having flanges on the peripheries thereof, and means for sealing the gap between a first sidewall panel and a second vertically adjacent sidewall panel, said sealing means comprising:

a body of extruded plastic having an attaching head including a substantially U-shaped portion having an inside wall and an outside wall, said inside wall and said outside wall connected by a hinge means for opening and closing said attaching head to facilitate mounting on the flange of one of said sidewall panels, a covering body connected to said attaching head for covering said gap between said sidewall panels, and a sealing tail connected to said covering body in such a manner as to engage against the other of said sidewall panels; and a spring clip for securing said attaching head to said sidewall panel, whereby air is prevented from entering said auto rack railroad car through the gap.

2. The sealing means as defined in claim 1, wherein said body further includes a securing tongue connected to said outside wall of said attaching head to further engage the flange and secure said attaching head to the flange of said sidewall panel.

3. The sealing means as defined in claim 2, wherein said body further includes a locking arm connected to said inside wall of said attaching head, whereby said securing tongue and said locking arm coact with said U-shaped portion to further engage the flange and secure attachment of said sealing means to the flange of said sidewall panel.

4. The sealing means as defined in claim 1, wherein said body further includes a locking arm connected to said inside wall of said attaching head to further engage the flange and secure said attaching head to the flange of said sidewall panel.

5. The sealing means as defined in claim 1, wherein said body further includes a bumper means extending from one of said attaching head, covering body, or sealing tail for preventing a vehicle door from contacting the sidewall panels.

6. The sealing means as defined in claim 5, wherein said bumper includes a flexible tapered impact-absorbing member in the form of a flap having an arcuate tail.

7. The sealing means as defined in claim 1, wherein the body is of extruded polyethylene.

8. The sealing means as defined in claim 1, which further includes locking means on the spring clip for securely engaging the attaching head.

9. The sealing means as defined in claim 8, wherein the locking means includes teeth which frictionally engage at least one of the inside and outside walls of the attaching head.

10. The sealing means as defined in claim 8, wherein the locking means include at least one locking indent on the spring clip adapted to engage a corresponding locking bar on the attaching head.

11. The sealing means as defined in claim 10, wherein the locking means includes a pair of opposing locking indents on the spring clip adapted to engage a pair of corresponding locking bars on the attaching head.

12. The sealing means as defined in claim 10, wherein the spring clip has an end portion that extends into the auto rack car and the attaching head further includes a clip protection bar extending from the inside wall which prevents contact with the end portion of the clip.

13. The sealing means as defined in claim 1, wherein the means for opening and closing said attaching head includes a live hinge connecting said inside and outside walls.

14. The sealing means as defined in claim 1, which further includes a scroll-shaped channel member means connected to said sealing tail and adapted to hook onto the flange of the sidewall panel adjacent to the sidewall panel on which the attaching head is mounted.

15. The sealing means as defined in claim 1, which further includes an accordion-shaped channel member means connected to said sealing tail and adapted to hook onto the flange of the sidewall panel adjacent to the sidewall panel on which the attaching head is mounted.

16. The sealing means as defined in claim 1, which further includes extension means connected to the covering body and adapted to extend into the gap to further seal the gap.

17. The sealing means as defined in claim 16, wherein the extension means includes an oval-shaped sealing member attached to the end of an extension arm opposite the end attached to the covering body.

18. The sealing means as defined in claim 16, wherein the extension means includes an arrow-shaped sealing member attached to the end of an extension arm opposite the end attached to the covering body.

19. The sealing means as defined in claim 1, where the covering body is connected to the inside surface of the inside wall of the attaching head.

20. The sealing means as defined in claim 1, wherein the covering body includes an area of reduced thickness which facilitates movement of the sealing tail in relation to the covering body.

21. In an auto rack railroad car having opposed walls, a roof and a floor, said opposed walls including a plurality of horizontally spaced apart and vertically extending posts and horizontally extending and vertically spaced apart sidewall panels between said posts, said panels, roof, and floor defining horizontally extending gaps between said sidewall panels, and between said sidewall panels, said roof, and said floor, and vertically extending gaps between said posts and said sidewall panels, said sidewall panels having peripheral flanges on the inner sides thereof, means for closing at least one of said gaps including a flexible plastic extruded member attachable to one of said flanges of one of said sidewall panels and extendable to and against one of the adjacent sidewall panels, posts, roof or floor, and a spring clip means for coacting with said plastic member to secure said member to said flange, said plastic extruded member comprising an elongated body having an attaching head means for engaging said sidewall panel flange, said attaching head means including a substantially U-shaped portion having an inside wall and an outside wall, said outside wall hingedly attached to said inside wall and movable between open and closed positions, and a closure flap extending from said attaching head means being formed and sized to biasingly engage said adjacent sidewall panel, post, roof, or floor to close the gap therebetween where the gaps may vary in size due to original construction, movement of said sidewall panels during transit, and/or thermal expansion of said panels.

22. The closing means as defined in claim 21, wherein said outside wall is hingedly attached to said inside wall by a live hinge.

23. In an auto rack railroad car for transporting vehicles having a frame, a floor on the frame, opposed side walls extending upward from the frame, a roof at the top of the side walls, and doors at the ends for loading and unloading vehicles, said side walls including a plurality of vertical posts extending between the frame and roof and a plurality of horizontally extending elongated vertically spaced apart sidewall panels mounted on and between the posts defining gaps between adjacent panels, between the uppermost panels and the roof, between the lowermost panels and the floor and between the panels and the posts, and each panel being peripherally flanged to define a flange in the form of a lip extending inwardly of the panel periphery and in substantial parallel relation to the panel, the improvement being in means for closing said gaps which comprises an extruded flexible plastic body having a closing wall adjustably spanning the gap to prevent the flow of air through the gap, a clamping portion at one end of the closing wall for engaging one of said flanges of one of said sidewall panels, said clamping portion including an outside wall attached to an inside wall by a live hinge and movable relative to said inside wall, a flap at the other end of the closing wall formed to be biased against said adjacent sidewall panel, roof, floor, or post, and means engaging said closing means to lock the closing means on the flange.

24. In an auto rack car having opposed side walls each including a plurality of horizontally extending and vertically spaced apart rectangular panels defining horizontally extending gaps between said panels, said panels having a main body and flanges along the upper and lower edges, each flange having a first leg extending from the body and a second leg extending from the first leg, said legs coacting with the body to define a channel, and a gap sealing device mounted on the flange legs of one panel and coacting with the adjacent panel to close the gap, said device comprising:

an extruded plastic body and at least one spring clip, said plastic body having an attaching head with first and second wall members connected by a live hinge and fitting over the second leg of the flange, and a closure flap extending from the attaching head and engaging the adjacent panel to close the gap between the panels, and said spring clip tightly fitting over the attaching head to secure the head to the flange.

25. The gap sealing device defined in claim 24, which further includes means connected to the closure flap for engaging the channel of the flange of said adjacent panel to assist in retaining the closure flap against the adjacent panel flange and compensate for movement between said panels.

26. The gap sealing device defined in claim 25, wherein said channel engaging means is scroll-shaped.

27. The gap sealing device defined in claim 25, wherein said channel engaging means is accordion-shaped.

28. The gap sealing device defined in claim 24, wherein the spring clip includes means for inhibiting removal of the clip once it has been placed on the attaching head.

29. The gap sealing device defined in claim 24, wherein the attaching head includes at least one outwardly projecting detent on at least one of the wall members, and said spring clip includes an indent coacting with the detent to lock the clip in place on the attaching head.

30. The gap sealing device defined in claim 24, wherein the spring clip is made of spring steel.

31. The gap sealing device defined in claim 24, wherein the spring clip is made of plastic.

32. In an auto rack railroad car having opposed walls, a roof, and a floor, said opposed walls including a plurality of horizontally spaced apart and vertically extending posts, horizontally extending and vertically spaced apart sidewall panels between said posts, and defining vertically extending gaps between said sidewall panels and said posts, said sidewall panels having flanges on the peripheries thereof, and means for sealing the gap between said sidewall panels and said posts, said sealing means comprising:

a body of extruded plastic having an attaching head including a substantially U-shaped portion having an inside wall and an outside wall, said inside wall and said outside wall connected by a hinge means for opening and closing said attaching head to facilitate mounting on the flange of said sidewall panels, a covering body connected to said attaching head for covering said gap between said sidewall panel and said post, and a sealing tail connected to said covering body in such a manner as to engage against said post; and a spring clip for securing said attaching head to said sidewall panel, whereby air is prevented from entering said auto rack railroad car through the gap.

33. The sealing means as defined in claim 32, wherein the means for opening and closing said attaching head includes a live hinge connecting said inside and outside walls.

34. The sealing means as defined in claim 33, wherein the covering body includes an area of reduced thickness to facilitate the rotation of the sealing tail.

35. The sealing means as defined in claim 34, wherein the gap sealing means further includes a tapered locking arm connected to said inside wall of said attaching head to further engage the flange and secure said attaching head to the flange of said sidewall panel.

36. The sealing means as defined in claim 32, wherein the covering body extends from the inside surface of the inside wall of the attaching head and includes an area of reduced thickness which facilitates movement of the sealing tail in relation to the covering body.

37. In an auto rack railroad car having opposed walls, a roof, and a floor, said opposed walls including a plurality of horizontally spaced apart and vertically extending posts supporting said roof, said walls including a plurality of horizontally extending and vertically spaced apart sidewall panels defining horizontally extending gaps between said sidewall panels and said roof, said sidewall panels having flanges on the peripheries thereof, and means for sealing the gap between said sidewall panels and said roof, said sealing means comprising:

a body of extruded plastic having an attaching head including a substantially U-shaped portion having an inside wall and an outside wall, said inside wall and said outside wall connected by a hinge means for opening and closing said attaching head to facilitate mounting on the flange of said sidewall panels, a covering body connected to said attaching head for covering said gap between said sidewall panel and said roof, and a sealing tail connected to said covering body in such a manner as to engage against said roof; and a spring clip for securing said attaching head to said sidewall panel, whereby air is prevented from entering said auto rack railroad car through the gap.

38. The sealing means as defined in claim 37, wherein the means for opening and closing said attaching head includes a live hinge connecting said inside and outside walls.

39. The sealing means as defined in claim 38, wherein the covering body includes an area of reduced thickness to facilitate the rotation of the sealing tail.

40. In an auto rack railroad car having opposed walls, a roof, and a floor, said opposed walls including a plurality of horizontally spaced apart and vertically extending posts, horizontally extending and vertically spaced apart sidewall panels defining horizontally extending gaps between said sidewall panels and said floor, said sidewall panels having flanges on the peripheries thereof, and means for sealing the gap between said sidewall panel and said floor, said sealing means comprising:

a body of extruded plastic having an attaching head including a substantially U-shaped portion having an inside wall and an outside wall, said inside wall and said outside wall connected by a hinge means for opening and closing said attaching head to facilitate mounting on the flange of said sidewall panels, a covering body connected to said attaching head for covering said gap between said sidewall panel and said floor, and a sealing tail connected to said covering body in such a manner as to engage against said floor; and a spring clip for securing said attaching head to said sidewall panel, whereby air is prevented from entering said auto rack railroad car through the gap.

41. The sealing means as defined in claim 40, wherein the means for opening and closing said attaching head includes a live hinge connecting said inside and outside walls.

42. The sealing means as defined in claim 41, wherein the covering body includes an area of reduced thickness to facilitate the rotation of the sealing tail.

43. In an auto rack railroad car having opposed walls each including a plurality of horizontally extending and vertically spaced apart sidewall panels defining horizontally extending gaps between sidewall panels, said sidewall panels having flange means on the peripheries thereof, a plastic device for sealing the gap between a first sidewall panel and a second adjacent sidewall panel, said sealing device comprising:

means for attaching said device to the flange means of said first sidewall panel, including a clip means and an outside wall hingedly attached to an inside wall by a live hinge means, said outside wall movable between open and closed positions, wherein said clip, said outside wall, and said inside wall coact to securely attach said sealing device to said flange of said first sidewall panel, means connected to and extending from said attaching means for adjustably covering the gap between said sidewall panels where the gap may vary in width due to original construction, movement of panels during transit, and thermal expansion of panels, whereby air is prevented from entering said auto rack railroad car through the gap.

44. In an auto rack railroad car having opposed walls each including a plurality of horizontally extending and vertically spaced apart sidewall panels defining horizontally extending gaps between said sidewall panels, said sidewall panels having flanges on the peripheries thereof, and means for sealing the gap between a first sidewall panel and a second vertically adjacent sidewall panel, said sealing means comprising:

a body of extruded plastic having an attaching head including a substantially U-shaped portion having an inside wall and an outside wall, said inside wall and said outside wall connected by a hinge means for opening and closing said attaching head to facilitate mounting on the flange of one of said sidewall panels, a covering body connected to said attaching head for covering said gap between said sidewall panels, and engaging the other of said sidewall panels, a spring clip for securing said attaching head to said sidewall panel, whereby air is prevented from entering said auto rack railroad car through the gap.

45. In an auto rack railroad car for transporting vehicles having a frame, a floor on the frame, opposed side walls extending upward from the frame, a roof at the top of the side walls, and doors at the ends for loading and unloading vehicles, said side walls including a plurality of vertical posts extending between the frame and roof and a plurality of horizontally extending elongated vertically spaced apart sidewall panels mounted on and between the posts defining gaps between adjacent panels, between the uppermost panels and the roof, between the lowermost panels and the floor and between the panels and the posts, and each panel being peripherally formed to define a channel having a flange extending inwardly of the panel periphery and in substantial parallel relation to the panel, the improvement being in means for closing the gaps between adjacent panels which comprises an extruded plastic body having an attaching head at one end fixedly mounted on the flange of one of the panels, and extendable channel engaging means at the other end for engaging within the channel of the other panel and accommodating variable gap width between said panels.

46. The closing means of claim 45, wherein said extendable channel engaging means is scroll-shaped.

47. The closing means of claim 45, wherein said extendable channel engaging means is accordion-shaped.

48. The closing means as defined in claim 45, wherein the attaching head includes a substantially U-shaped portion having an inside wall and an outside wall, said inside wall and said outside wall connected by a hinge means for opening and closing said attaching head to facilitate mounting on the flange of said sidewall panel.

49. In an auto rack railroad car for transporting vehicles having a frame, a floor on the frame, opposed side walls extending upward from the frame, a roof at the top of the side walls, and doors at the ends for loading and unloading vehicles, said side walls including a plurality of vertical posts extending between the frame and roof and a plurality of horizontally extending elongated vertically spaced apart sidewall panels mounted on and between the posts defining gaps between adjacent panels, between the uppermost panels and the roof, between the lowermost panels and the floor and between the panels and the posts, and each panel being peripherally formed to define a channel having a flange extending inwardly of the panel periphery and in substantial parallel relation to the panel, the improvement being in means for closing said gaps which comprises an extruded plastic body having an attaching head at one end fixedly mounted on a flange of a panel, and a closure flap extending from said attaching head to close the gap adjacent the panel on which the attaching head is mounted, said attaching head including a first portion disposed against one side of said flange, a second portion connected to said first portion by a live hinge and disposed against the opposite side of the flange, and a U-shaped spring clamp overlying said portions and said hinge and forcing said portions into locking engagement with said flange.

50. The closing means of claim 49, wherein said spring clamp is metal.

51. The closing means of claim 49, wherein said closure flap closes a gap between adjacent sidewall panels.

52. The closing means of claim 49, wherein said closure flap closes a gap between a sidewall panel and a vertical post.

53. The closing means of claim 49, wherein said closure flap closes a gap between a sidewall panel and the roof.

54. The closing means of claim 49, wherein said closure flap closes a gap between a sidewall panel and the floor.

* * * * *